US012274315B2

(12) United States Patent
Leddy

(10) Patent No.: US 12,274,315 B2
(45) Date of Patent: Apr. 15, 2025

(54) SUPPORT GARMENT

(71) Applicant: Bust A Move LLC, Shaker Heights, OH (US)

(72) Inventor: Alison Leddy, Shaker Heights, OH (US)

(73) Assignee: Bust A Move LLC, Shaker Heights, OH (US)

( * ) Notice: Subject to any disclaimer, the term of this patent is extended or adjusted under 35 U.S.C. 154(b) by 8 days.

(21) Appl. No.: 18/037,225

(22) PCT Filed: Nov. 16, 2021

(86) PCT No.: PCT/US2021/059434

§ 371 (c)(1),
(2) Date: May 16, 2023

(87) PCT Pub. No.: WO2022/104235

PCT Pub. Date: May 19, 2022

(65) Prior Publication Data

US 2023/0404176 A1 Dec. 21, 2023

Related U.S. Application Data

(60) Provisional application No. 63/114,031, filed on Nov. 16, 2020.

(51) Int. Cl.
*A41C 3/00* (2006.01)
*A41F 15/00* (2006.01)

(52) U.S. Cl.
CPC ..... *A41C 3/0057* (2013.01); *A41C 3/0021* (2013.01); *A41F 15/002* (2013.01)

(58) Field of Classification Search
CPC .... A41C 3/0057; A41C 3/0021; A41F 15/002
See application file for complete search history.

(56) References Cited

U.S. PATENT DOCUMENTS 1,584,525 A * 5/1926 Freeman ..... A41C 3/00 24/697.2
2,638,595 A 5/1953 Goebel
(Continued)

OTHER PUBLICATIONS

Glamorise Camisole Wire Sport Bra #9160 Retrieved Sep. 11, 2020 https://www.macys.com/shop/product/glamorise-camisole-wire-sport-bra-9160?ID=10486965.

(Continued)

*Primary Examiner* — Gloria M Hale
(74) *Attorney, Agent, or Firm* — Dinsmore & Shohl LLP

(57) ABSTRACT

A support garment (10) includes a front panel (12) and a back panel (14). The front panel (12) includes an inner layer (18) and an outer layer (20). The inner layer (18) includes a first cup (34), a second cup (34), and a first pair of straps (62). The outer layer (20) includes a second pair of straps (64). The outer layer (20) is configured to provide compression when worn. The first pair of straps (62) and the second pair of straps (64) each extend between the front panel (12) and the back panel (14). The support garment (10) also includes a band (16) defining a torso opening (22). The band (16) extends below the front panel (12) and the back panel (14). The support garment (10) is configured to apply lateral tension to the first cup (34) and the second cup (34).

20 Claims, 9 Drawing Sheets

(56) References Cited

U.S. PATENT DOCUMENTS

| | | | | |
|---|---|---|---|---|
| 4,444,191 | A * | 4/1984 | Harned | A41C 3/0057 2/45 |
| 4,741,719 | A | 5/1988 | Wirth | |
| 5,871,388 | A | 2/1999 | Lambert | |
| 5,951,364 | A | 9/1999 | Brown et al. | |
| 5,968,003 | A | 10/1999 | Sisson | |
| 6,755,717 | B2 * | 6/2004 | Smith | A41C 3/0057 128/869 |
| 7,909,675 | B1 * | 3/2011 | Rainey | A41C 3/02 450/59 |
| 8,172,639 | B2 | 5/2012 | Swendseid | |
| 8,858,295 | B2 * | 10/2014 | Thompson | A41C 3/0028 450/10 |
| 9,578,901 | B2 | 2/2017 | Randall et al. | |
| 10,136,681 | B1 * | 11/2018 | Malik | A41C 3/0064 |
| 10,485,270 | B2 | 11/2019 | Wesley | |
| 10,568,367 | B2 * | 2/2020 | Hawkins-Whetstone | A41C 3/0057 |
| 11,583,010 | B1 * | 2/2023 | Yarbrough | A41C 3/0057 |
| 2002/0022433 | A1 | 2/2002 | Yeung et al. | |
| 2003/0166375 | A1 * | 9/2003 | Noel | A41C 3/0057 450/1 |
| 2006/0025039 | A1 | 2/2006 | Barbour et al. | |
| 2006/0089083 | A1 | 4/2006 | Tonsor | |
| 2006/0094335 | A1 | 5/2006 | Fildan et al. | |
| 2009/0126084 | A1 | 5/2009 | Fenske | |
| 2009/0233522 | A1 | 9/2009 | Schlatmann | |
| 2011/0117818 | A1 | 5/2011 | Barnard | |
| 2012/0045967 | A1 * | 2/2012 | Punsal | A41C 3/0057 450/82 |
| 2015/0099420 | A1 * | 4/2015 | Reinhard | A41C 3/02 450/58 |
| 2016/0000154 | A1 | 1/2016 | Furis | |
| 2016/0249688 | A1 | 9/2016 | Ibey et al. | |
| 2018/0325186 | A1 | 11/2018 | Yamamoto et al. | |
| 2019/0174840 | A1 * | 6/2019 | Paulson | A41C 3/0014 |
| 2020/0037673 | A1 | 2/2020 | Storelli et al. | |

OTHER PUBLICATIONS

Alexander Wang X H&M Sports Bra—NWT Size 10 Retrieved Sep. 10, 2020 https://www.ebay.com/itm/ALEXANDER-WANG-X-H-M-Sports-Bra-NWT-Size-10-/192902143428.

Puma Womens Training Bra by Puma Retrieved Sep. 10, 2020 https://cnalifestyle.channelnewsasia.com/style/how-to-choose-the-right-sports-bra-11615290.

Everie Everie Seamless Bra Retrieved Sep. 10, 2020 https://everiewoman.com/products/seamless-bra.

* cited by examiner

SUPPORT GARMENT

CROSS REFERENCE TO RELATED APPLICATIONS

This application claims the priority benefit of U.S. Provisional Patent Application No. 63/114,031, filed Nov. 16, 2020, and Patent Cooperation Treaty Application No. PCT/US21/59434, filed Nov. 16, 2021, which are hereby incorporated herein by reference in their entirety.

TECHNICAL FIELD

Embodiments of the technology relate, in general, to a support garment, and in particular to a bra that has support features.

BACKGROUND

Support garments, such as sports bras, are designed to reduce the movement of breasts during physical activity. Such movement of breasts can feel painful and uncomfortable, and can also negatively affect performance and overall experience during physical activity. Sports bras can help to properly support breasts, but most bras are not designed with particular attention to large breasts. In general, sports bra designs are often secured either at the front or rear, such as with a hook and eye closure or a zipper, or have no closure and are intended to stretch while being pulled on over the head and shoulders. Many sports bras also commonly have adjustable shoulder straps and provide some level of compression to the breasts. However, existing bra designs do not provide adequate three-dimensional support to reduce substantial movement of breasts, especially large breasts, during activity. A need exists for a support garment that provides improved support and stability of breasts during physical activity.

SUMMARY

In an embodiment, a support garment includes a front panel and a back panel. The front panel includes an inner layer and an outer layer. The inner layer includes a first cup, a second cup, and a first pair of straps. The outer layer includes a second pair of straps. The outer layer is configured to provide compression when worn. The first pair of straps and the second pair of straps each extend between the front panel and the back panel. The support garment also includes a band defining a torso opening. The band extends below the front panel and the back panel. The support garment is configured to apply lateral tension to the first cup and the second cup.

BRIEF DESCRIPTION OF THE DRAWINGS

The present disclosure will be more readily understood from a detailed description of some example embodiments taken in conjunction with the following figures.

DETAILED DESCRIPTION

Figure 2:
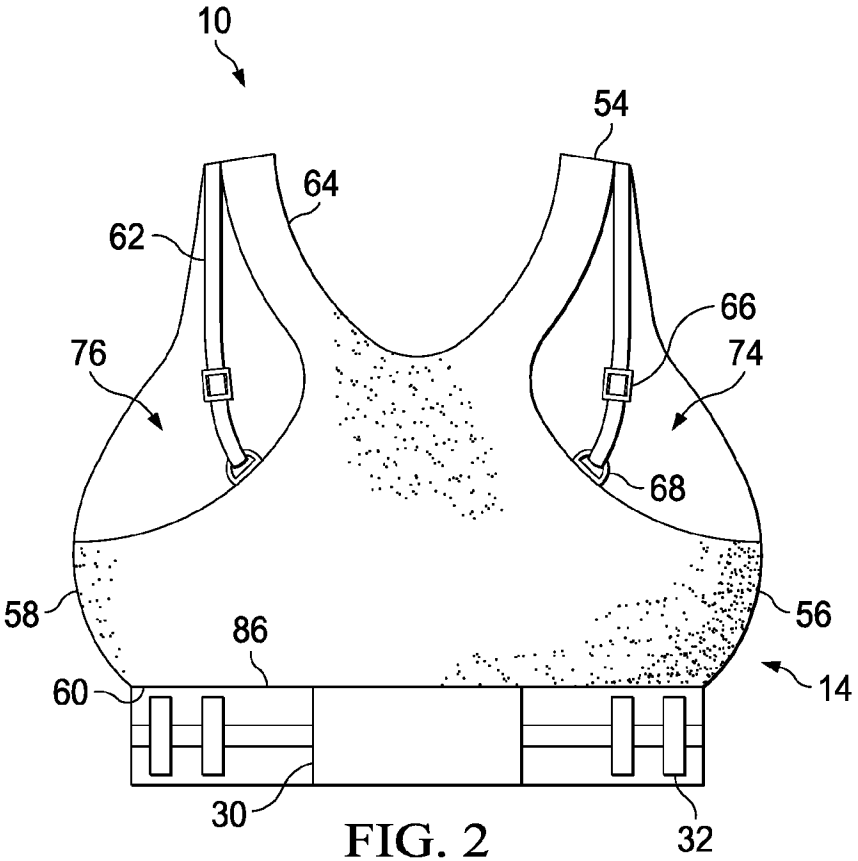
FIG. 2 depicts a rear view of the support garment of FIG. 1.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment," or "in an embodiment" in places throughout the specification are not necessarily all referring to the same embodiment. Furthermore, the particular features, structures or characteristics may be combined in any suitable manner in one or more embodiments.

Described herein are example embodiments of devices and methods for an improved support garment. In one example embodiment, a support garment, such as a bra, includes a front panel, a back panel, and one or more support bands that extend around the back panel and are secured together at the front of the support garment. In some embodiments, the front panel includes a first separation layer and a second compression layer. In some embodiments, the support garment includes two separate pairs of shoulder straps. Example embodiments are shown in FIGS. 1-14, which are described further below.

The examples discussed herein are examples only and are provided to assist in the explanation of the apparatuses, devices, systems and methods described herein. None of the features or components shown in the drawings or discussed below should be taken as mandatory for any specific implementation of any of these the apparatuses, devices, systems or methods unless specifically designated as mandatory. For ease of reading and clarity, certain components or methods may be described solely in connection with a specific figure. Any failure to specifically describe a combination or sub-combination of components should not be understood as an indication that any combination or sub-combination is not possible. Also, for any methods described, it should be understood that unless otherwise specified or required by context, any explicit or implicit ordering of steps performed in the execution of a method does not imply that those steps must be performed in the order presented but instead may be performed in a different order or in parallel.

Example embodiments described herein can provide improved support for the breasts by, for example, reducing the Moment of Inertia. During physical activity, there is movement of breasts that is similar to whiplash and is caused by Inertia, calculated as follows:

$$\text{Inertia}=(\text{Mass of the breast})\times(\text{Distance between the rib cage and the apex of breast})^2$$

Inertia is resistance to change in motion, so with more inertia, an object is slower to move or slower to catch up to the motion of an adjacent object. During physical activity, breasts are impacted by inertia so there is resistance to the movement of the entire body. For example, consider jumping up in the air: the body leaves the ground, reaches the peak of the jump, and lands on the ground. During that activity, the breasts are pulled from rest as the body leaves the ground, the breasts continue to move upward even as the body reaches the peak, the breasts reach their peak and are pulled down as the body lands, and finally the breasts return to rest after the body is at rest. The movement of breasts is delayed due to inertia, which causes pain and discomfort and negatively affects performance. Specifically, the inertia of breasts can cause strain on the shoulders and neck, pain in the breast tissue itself, and potentially torn Cooper's Ligaments among other health problems if breasts are not properly supported. Inertia increases as breast size increases, so the level of support for large breasts from a support garment should be increased as well. This resistance to motion as defined by inertia applies in three-dimensions, and it increases as breast size increases. Breasts move naturally in a figure-8 direction across the X (side to side) and Y (up and down) planes as well as the Z (in and out) plane during physical activity. Various embodiments described herein use a combination of support mechanisms that work in tandem to reduce breast movement in all three planes during physical activity.

Embodiments described herein combine compression, encapsulation, and separation to reduce inertia for breasts, including large breasts. For example, if there is less distance between the rib cage and the apex of the breast, there will be less inertia. Compression may reduce the distance of the breast apex to the rib cage. Separation of the breast tissue, as discussed below, may move the breast tissue towards the armpits, which may also reduce the distance. In contrast, common sports bras often result in breasts being compressed together which causes the breasts to move together as one entity. This singular entity is known as a "uniboob" and has the mass of the combined breasts, which effectively doubles the inertia compared to the breasts being separate. Encapsulation may reduce the amount of "uniboob" but often cannot prevent it entirely, especially for large breasts. Common sports bras do not accommodate the volume of breast tissue in many sizes, but especially breasts that protrude out 3 inches or more from the rib cage (i.e., C cup and larger). Various embodiments described herein use encapsulation to contain the breast tissue and position it optimally, compression to reduce the distance, and separation to actively keep breasts apart and try to prevent "uniboob" while reducing the distance.

Figure 1:
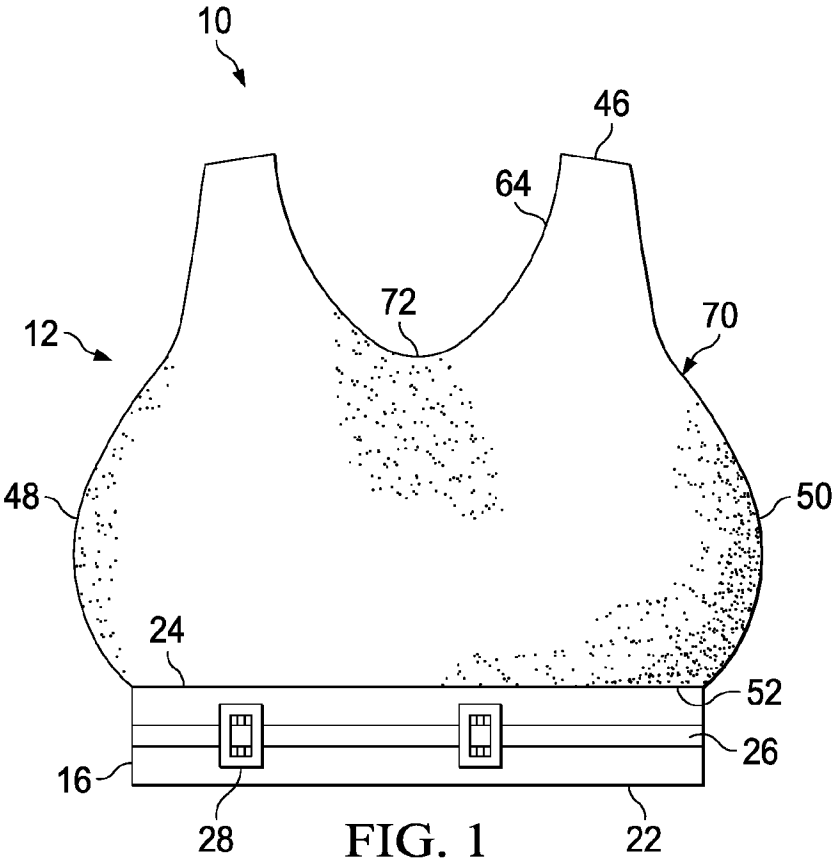
FIG. 1 depicts a front view of a support garment according to an embodiment.

Referring now to FIGS. 1 and 2, an example support garment 10 is shown. The support garment 10 includes a front panel 12, a back panel 14, and a band 16. In various embodiments, the front panel 12 includes an inner layer 18 and an outer layer 20 (see FIG. 6). The inner layer 18, when worn, encapsulates the breasts and separates them from each other. The inner layer 18 positions the breasts to be lifted up and off the rib cage, without tension across the skin of the upper bust and neck, and with a natural gap between the two breasts. The outer layer 20 then provides compression to the properly positioned breasts, which reduces the distance of the breast apex to the rib cage. The support garment 10 positions the breasts into a mechanically-advantageous position and then compresses the tissue. The support garment 10 avoids pushing the breasts together (i.e., increasing cleavage) as many existing sports bras do. The band 16 reduces the downward motion of the breasts and acts as an anchor from which tension can be applied by shoulder straps and other components to counteract motion during physical activity. The band 16 and inner and outer layers 18, 20 are discussed further below.

Still referring to FIGS. 1 and 2, the band 16 extends downward from the bottom of the front panel 12 and the back panel 14. The band 16 extends around the bottom of the support garment 10 and defines the torso opening 22. The height of the band may vary. For example, the height of the band may be 1.5 inches. It should be appreciated that the band 16 may be integral with the front panel 12 and/or the back panel 14. The band 16 maintains proper positioning of breast tissue and reduces movement of breasts during physical activity. When snug against the rib cage, the band 16 minimizes "underboob" in which the breast tissue "sags" or rests on the rib cage below the end of the breast. In this position, the band 16 resists gravity and reduces the downward range of motion of the breasts. The band 16 also acts as an anchor so that the shoulder straps (discussed further below) as well as the inner and outer layer 18, 20 can apply tension to the breasts and move them into a mechanically-advantageous position. In an embodiment, the support garment 10 includes a seam between the band 16 and one or more of the front panel 12 and the back panel 14. For example, the support garment 10 may include a seam 24 between the band 16 and the bottom of the outer layer 20, which would be positioned under the breast tissue when worn. While FIGS. 3, 4, 11, and 12 do not show a band, it should be recognized that the illustrated support garments may include a band.

In various embodiments, the tightness of the band 16 on the user may be adjustable. For example, the support garment 10 may include an adjustable belt 26 positioned over the band 16. The belt 26 may be adjusted by the user from an initial, relaxed state to a second, tightened state. Adjustment of the belt 26 corresponds to adjusting the tightness of the band 16 on the user. Using the belt 26 to adjust the tightness of the band 16 allows the band 16 to have a looser initial fit. A configuration where the tightness or tension of the band 16 is adjustable may improve the ease with which the user puts on the support garment 10. It may also reduce the chance of the material of the band 16 stretching out over time. The amount of tightening and the length of the belt 26 depends on each individual user's size, comfort level, and the size of the support garment 10. The tightness of the belt 26 is intended to be constant during exercise and keep the band 16 in place on the rib cage. Although there may be some movement or loosening during activity, especially if very strenuous, the belt 26 will not return to its original, relaxed position. In an embodiment, the belt 26 may be configured to lock in the tightened position to ensure the tightness does not change during motion.

Adjusting the tightness or tension of the band 16 allows for users to fit the bra to their bodies, which is particularly beneficial to users with relatively large breasts and small rib cages. As described, a proper fit includes the band 16 snug against the rib cage so that all breast tissue sits above it. The support garment 10 is then able to use the band 16 as an anchor to better position the breasts and reduce inertia. The belt 26 may be configured to be adjusted at the front, side, or back of the support garment 10. The belt 26 may have different fasteners or techniques to adjust the tension or tightness. As shown in FIG. 1, the belt 26 may include a slider 28 to allow the belt 26 to be tightened against a user's rib cage. The belt 26 is looped through another slider 28 or a lashing ring, and the belt 26 may be fitted to the user using the slider 28. The lashing ring may be, for example, an O-ring, a D-ring, or a rectangular ring. In an embodiment, the belt 26 may include more than one slider 28 to be able to adjust the belt 26 in multiple locations. In some embodiments, the belt 26 may have, without limitation, a slider, a buckle, a hook-and-eye closure, hook-and-loop closure (e.g., VELCRO), a zipper, or a combination thereof. The belt 26 may be configured to retain the excess length within the confines of the belt 26 or, alternatively, the excess length of the tightened belt 26 may be free-hanging. The fasteners may be made of, without limitation, a metal or a polymer, such as a plastic or silicone. In an embodiment, the fastener may be textured (e.g., ridged) or coated with a material to increase friction to create a "locking" effect and better maintain that position during motion.

In some embodiments, the belt 26 may be secured to the band 16. For example, as shown in FIG. 2, the band 16 may define a channel 30 through which the belt 26 extends. Additionally, or alternatively, the band 16 may include belt loops 32 that hold the belt 26 against the band 16. While the channel 30 and belt loops 32 are shown at the back of the support garment 10 in FIG. 2, the location is not so limited. The channel 30 and/or the belt loops 32 may be on the front of the support garment 10, side(s) of the support garment 10, back of the support garment 10, or a combination thereof. For example, the belt loops 32 may be spaced apart around the entire circumference of the support garment 10. In an embodiment, a portion of the belt 26 may be attached to the band 16 (e.g., sewn together).

In some embodiments, the size or material of the band 16 or the belt 26 may vary. For example, the material of the band 16 may be the same as the material for the outer layer 20 or the back panel 14. In another example, the material of the band 16 and/or the belt 26 may be elastic. The firmness or tension of the elastic may vary. The height of the band 16 and/or the belt 26 may vary. In an embodiment, the height of the band 16 and/or the belt 26 may be in a range of 0.5 inches to 3 inches. For example, the belt 26 may have a height of 1.5 inches. The band 16 and the belt 26 may have the same height or different heights.

As discussed above, the inner layer 18 encapsulates and separates the breasts from each other. The inner layer 18 holds the breasts in a mechanically-advantageous position where the breast tissue sits and goes out directly from where the breasts start on the rib cage so it is not "sagging." The inner layer 18 covers at least a majority of the surface area of each breast, or at least one breast if there is a significant size difference between the two as mentioned below. In some embodiments, the inner layer 18 may include two compartments, such as cups 34. Each of the cups 34 fit around a breast and counteract gravity with tension from the corresponding shoulder strap. The tension applied by the straps pull the breasts up and away from each other, which is different than a push-up bra or other bra that utilizes padding to push the breasts up from the rib cage and often together into a "uniboob." The adjustability of the inner layer 18 is beneficial, for example, when a user has asymmetrical breast size. It is common for there to be at least a half cup size difference between one breast and the other. It may also be beneficial where a user has had a mastectomy because the strap for the smaller breast can be tightened to a higher degree compared to the strap for the larger breast. It should be understood that the drawings are for illustration purposes, and the relative proportions of the support garment may vary significantly. For example, the size of the cups relative to the width of, for example, the band may differ.

Figure 6:
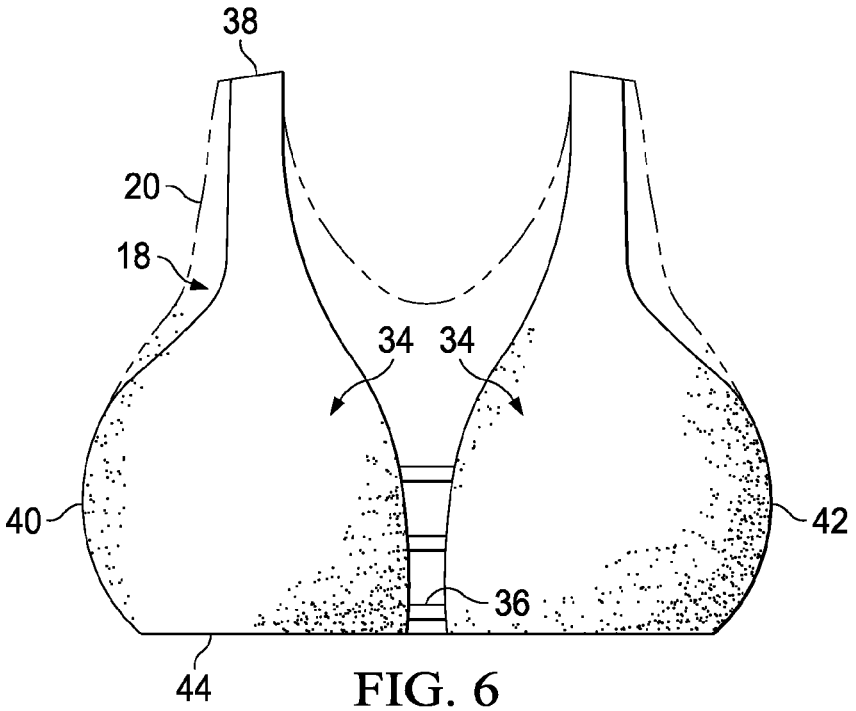
FIG. 6 depicts the inner layer of the support garment of FIG. 1.

The cups 34 may be uncoupled or coupled. In an embodiment, as shown in FIG. 6, the cups 34 may extend down to the bottom of the inner layer 18 without touching. Thus, the cups 34 may be spaced apart from each other such that the inner layer 18 is discontinuous. Also shown in FIG. 6, in an embodiment, the cups 34 may be indirectly coupled using, for example, stitches 36, a piece of fabric similar to or including mesh, a zipper, hook-and-eye closures, etc. In another example, the cups 34 may cross over or overlap each other (e.g., similar to a wrap-style shirt) with or without being coupled to each other. In such an embodiment, the bottom of the cups 34 may be individually sewn to the outer layer 20 or band 16. The cups 34 may be coupled at a bottom portion. For example, the cups 34 may be coupled together at a bottom portion and then separate to form a V-neck shape. The cups 34 may be coupled together, for example, at the bottom 1 to 5 inches of the inner layer 18, such as the bottom 3 inches. In another example, the inner layer 18 may include a seam that separates the inner layer 18 into two cups 34.

The cups 34 are sized to accommodate the volume of the breast tissue and the distance that it extends out from the rib cage (similar to traditional cup sizes). It will be appreciated that the shape and size of the inner layer 18 may vary. The contour and composition of the cups 34 may vary. Fabric having different properties may be used at different portions of the cups 34 to better encapsulate and hold the breast tissue in the optimal position on the rib cage. The cups 34 may be configured to reduce relative movement between the breasts and cups 34. For example, the cups 34 may include elastic to allow the cup 34 to move with the breast without being displaced. In an embodiment, the inner surface of the inner layer 18 (i.e., the surface facing the skin of the user) may include silicone or another material to keep the breasts from shifting out of position during physical activity. Contouring or fabric composition at the outer edge of the cups 34 can push the breast tissue into the cup 34.

The material of the inner layer 18 may vary. Materials for the inner layer 18 may be stretchable, elastic, and/or breathable and can be in various forms such as a mesh or a knitted fabric. Suitable materials for the inner layer 18 include, without limitation, polyester, a polyester mix, nylon, a nylon mix, LYCRA, a LYCRA mix, spandex, a spandex mix, cotton, a cotton mix, or a combination thereof. Some or all of the material may include recycled materials. There could also be a foam material used to form the cups 34. Additionally, the inner layer 18 may be composed of multiple types of fabric. In an example embodiment, the inner layer 18 includes a polyester mesh layer and a spandex mix layer. The inner layer 18 may have a seam, such as a princess seam, across the apex of each breast. It may also have darts above and below the apex of the breast. The cups 34 may be molded cups. For example, heat may be applied to the fabric to form a dome shape. In an embodiment, the material for the inner layer 18 may be compressive to pull the breasts inward and reduce the distance between the breasts and the rib cage. The support garment 10 may be configured, in some embodiments, to allow additional inserts to be added (e.g., for modesty). For example, the inner layer 18 may be made of a first layer and a second layer and may include openings between the first and second layers through which an insert may be positioned.

With further reference to FIG. 1, the outer layer 20 provides compression to most or all of the breast tissue. In some embodiments, the outer layer 20 may conceal the inner layer 18 (i.e., the inner layer 18 does not extend beyond the outer layer 20). The outer layer 20 works to compress the breasts towards the body and thus reduce the distance of the breast from the rib cage. Decreasing the distance decreases the inertia that affects breast movement. The outer layer 20 covers the user's breast tissue in the front as well as at the side. The outer layer 20 is sized to reduce or prevent spilling of breast tissue outside of the support garment 10, which would reduce support and comfort. In an embodiment, the outer layer 20 does not include any features specifically designed to separate the breasts (e.g., a center seam between the breasts, cups, a barrier, etc.).

The material of the outer layer 20 may vary. Materials for the outer layer 20 may be stretchable, elastic, and/or breathable. Suitable materials for the outer layer 20 include, without limitation, polyester, a polyester mix, spandex, a spandex mix, a polyester-spandex mix, LYCRA, a LYCRA mix, a polyester-LYCRA mix, nylon, a nylon mix, a spandex-nylon mix, a polyester-nylon mix, or a combination thereof. Different portions of the outer layer 20 may be made of different material to provide varying levels of compression. The material of the outer layer 10 may be chosen to avoid chafing for the sake of the user's comfort.

Referring again to FIGS. 1 and 2, the inner layer 18 may have a top edge 38, a first side edge 40, a second side edge 42, and a bottom edge 44. The shoulder straps as discussed below may cause the top edge 38 to be discontinuous. Similarly, the outer layer 20 may have a top edge 46, a first side edge 48, a second side edge 50, and a bottom edge 52. The shoulder straps as discussed below may cause the top edge 46 to be discontinuous. The inner layer 18 and the outer layer 20 may be coupled at various locations. For example, the inner and outer layers 18, 20 may be coupled at each side of the support garment 10 (e.g., first side edges 40, 48 are coupled together and second side edges 42, 50 are coupled together). In an embodiment, the bottom edges 44, 52 of the inner and outer layers 18, 20 may be coupled together. The inner layer 18, in some embodiments, may extend around the back of the wearer (i.e., the back panel 14 is multi-layered). In such an embodiment, the inner layer 18 could be coupled to the bottom edge of the back panel 14. The inner and outer layers 18, 20 may be coupled using a variety of techniques, such as sewing, gluing, bonding, etc.

Figure 3:
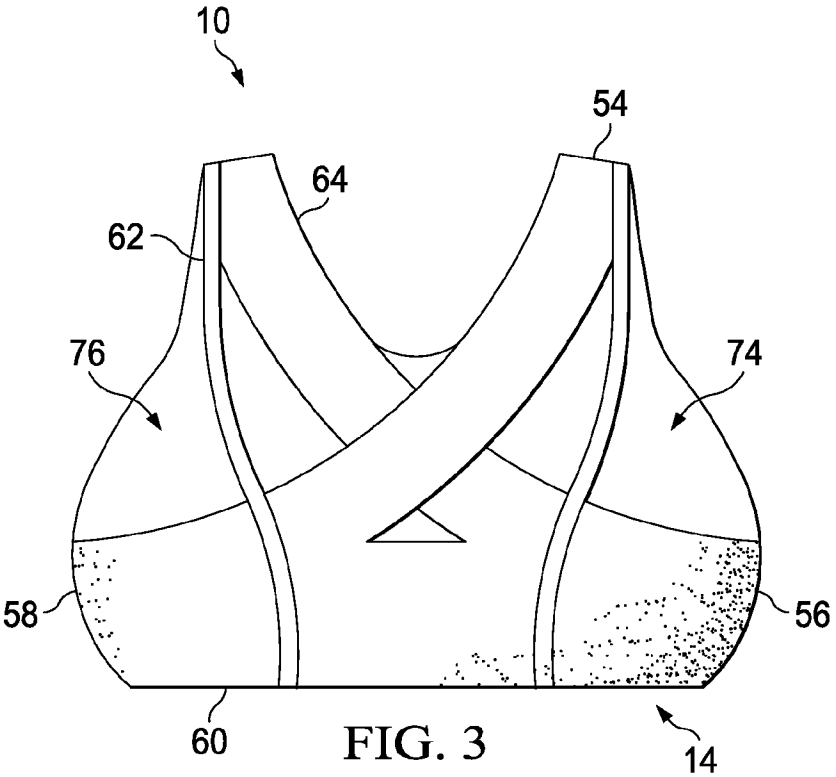
FIG. 3 depicts a rear view of a support garment according to an embodiment.

Now referring to FIG. 3, the back panel 14 extends from the front panel 12 around the back of the wearer. Each of the front panel 12 and the back panel 14 may extend partially around each side of the wearer. The material of the back panel 14 may vary. In an embodiment, the back panel 14 does not include a closure feature (e.g., eye and hook, snap, etc.). The back panel 14 may have a top edge 54, a first side edge 56, a second side edge 58, and a bottom edge 60. The shoulder straps as discussed below may cause the top edge 54 to be discontinuous. In some embodiments, the front panel 12 and the back panel 14 may be integral. In some embodiments, the front panel 12 and the back panel 14 may be coupled, for example, at the sides of the support garment 10. In an embodiment, the first side edge 56 of the back panel 14 may be coupled to the first side edge 48 of the outer layer 20, and the second side edge 58 of the back panel 14 may be coupled to the second side edge 50 of the outer layer 20. In another embodiment, the first side edge 56 of the back panel 14 may be coupled to the first side edges 40, 48 of the inner and outer layers 18, 20, and the second side edge 58 of the back panel 14 may be coupled to the second side edges 42, 50 of the inner and outer layers 18, 20. There may be openings between the layers as discussed further below.

Materials for the back panel 14 may be stretchable, elastic, and/or breathable and can be in various forms such as a mesh or a knitted fabric. Suitable materials for the back panel 14 include, without limitation, polyester, a polyester mix, spandex, a spandex mix, a polyester-spandex mix, LYCRA, a LYCRA mix, a polyester-LYCRA mix, nylon, a nylon mix, a spandex-nylon mix, a polyester-nylon mix, or a combination thereof. Some or all of the material may include recycled materials. Additionally, the back panel 14 may be composed of multiple types of fabric. In some embodiments, the back panel 14 is made of the same material as the outer layer 20 of the front panel 12.

With reference to FIGS. 1-4, the support garment 10 includes shoulder straps. In some embodiments, the support garment 10 includes two pairs of shoulder straps. For example, a first pair of straps 62 may extend from the inner layer 18 of the front panel 12 over the shoulder and to the back of the support garment 10, and a second pair of straps 64 may extend from the outer layer 20 of the front panel 12 over the shoulder and to the back of the support garment 10. Each strap of the first pair of straps 62 may be coupled to or integral with one of the cups 34 of the inner layer 18. In some embodiments, the shoulder straps may be fixed or may be adjustable. Where there are two pairs of shoulder straps, neither pair, one of the pairs, or both pairs may be adjustable in various embodiments. For example, the first pair of straps 62 may be adjustable to allow the user to adjust the amount of tension placed on each breast by each of the cups 34. In an embodiment, the first pair of straps 62 may include sliders 66 to adjust the tension of each of the straps. In another embodiment, the first pair of straps 62 may include a hook-and-loop fastener (e.g., VELCRO) to allow the user to adjust the tension. The two pairs of straps 62, 64 allows for providing more tension across the breasts without applying pressure to the top and back of the shoulders in one specific area, where it could be painful. The pressure on any given point across the shoulders and back decreases due to the increased surface area of the combined straps. The two sets of straps leverage the stability of the band 16 as an anchor so the user can pull the breasts into the optimal position and so the tension applied can keep the breasts in an optimal position, particularly during physical activity. The straps 62, 64 help to counteract the weight of the breasts, without placing the entire strain of that weight on one or few points across the back and shoulders. The straps 62 are able to pull—not push—the breasts in an upward and outward direction towards the shoulders. This counteracts the gravity and side-to-side motion of the breast, as well as the up-and-down motion of the breast to a certain extent. The positioning and stability that the shoulder straps provide, particularly to users with large breasts, is enhanced by the anchoring effect provided by the band 16 and, where present, the belt 26.

The first and second pair of straps 62, 64 may have different shapes. In an embodiment, one of the pair of straps 62, 64 are generally straight and the other of the pair of straps 62, 64 have a racerback shape (as shown in FIG. 2). Having two pairs of shoulder straps, each with a different shape, may reduce the pressure on the wearer's neck and shoulders. For example, by increasing the surface area where the straps meet the skin, the pressure from the weight of the breasts is distributed over a greater area. In an embodiment, both pairs of straps 62, 64 are visible from the front, back, or both. As shown in FIG. 1, in an embodiment, the straps 64 are visible from the front and block the straps 62 from view. In another embodiment, the straps 62 may be visible from the front (i.e., the front of the straps 62 are not covered by the straps 64). When worn, the visibility of the straps may change depending on the size and shape of the user. Thus, the visibility of the straps may be described based upon laying flat on a surface or hanging on a hanger.

The shape of the first pair of straps 62 may vary. For example, in FIG. 1, the first pair of straps 62 extend straight down from the top of the shoulder to the back panel 14. In another embodiment, the first pair of straps 62 can be at an angle moving outward or inwards relative to the shoulders. At the shoulders, the first pair of straps 62 may be under the second pair of straps 64 or may be spaced apart from the second pair of straps 64.

The second pair of straps 64 increase the surface area of the support garment 10 on the shoulders and back of the user to counterbalance the breast weight. The coverage of the user's back by the second pair of straps 64 and outer layer 20 dampens the oscillations of the breast tissue at the front of the body and reduces the overall bounce of the breasts. The shape of the second pair of straps 64 may vary. For example, the second pair of straps 64 may be configured to crisscross (e.g., different sized crisscrosses in FIGS. 3 and 4), define a keyhole, be straight from the top of the shoulders down to the back panel (e.g., like a sleeveless shirt), or another configuration. The width of the second pair of straps 64 may vary as seen in a comparison of FIGS. 3 and 4. The proportion of the back covered by the support garment 10 may vary. For example, adjusting the size and angle of the racerback shape would allow for more or less skin to be covered. The size of the straps 62, 64 and amount of skin covered by the support garment 10 may depend on the breast size of the intended user or on personal preference.

The straps may be integral with the support garment 10 or may be coupled to different components of the support garment 10. In various embodiments, the first pair of straps 62 may be integral with the inner layer 18 and back panel 14, integral with the inner layer 18 and coupled to the back panel 14, or coupled to both the inner layer 18 and the back panel 14. Similarly, the second pair of straps 64 may be integral with the outer layer 20 and the back panel 14, integral with the outer layer 20 and coupled to the back panel 14, or coupled to both the outer layer 20 and the back panel 14. For example, in FIG. 3, the second pair of straps 64 may be sewn to (i.e., coupled to) the back panel 14. As another example, in FIG. 4, the back panel 14 and the back of the straps 64 may be considered to be integral if there is no clear delineation between where the back of the straps end and where the back panel begins. In another embodiment, the straps may be defined by a portion of the front panel 12 and a portion of the back panel 14. For example, the second pair of straps 64 may have a front portion integral with the outer layer 20 of the front panel 12 and a back portion integral with the back panel 14. The front and back portions of the second pair of straps may be coupled, for example, at the top of the shoulders or may be integral.

Figure 4:
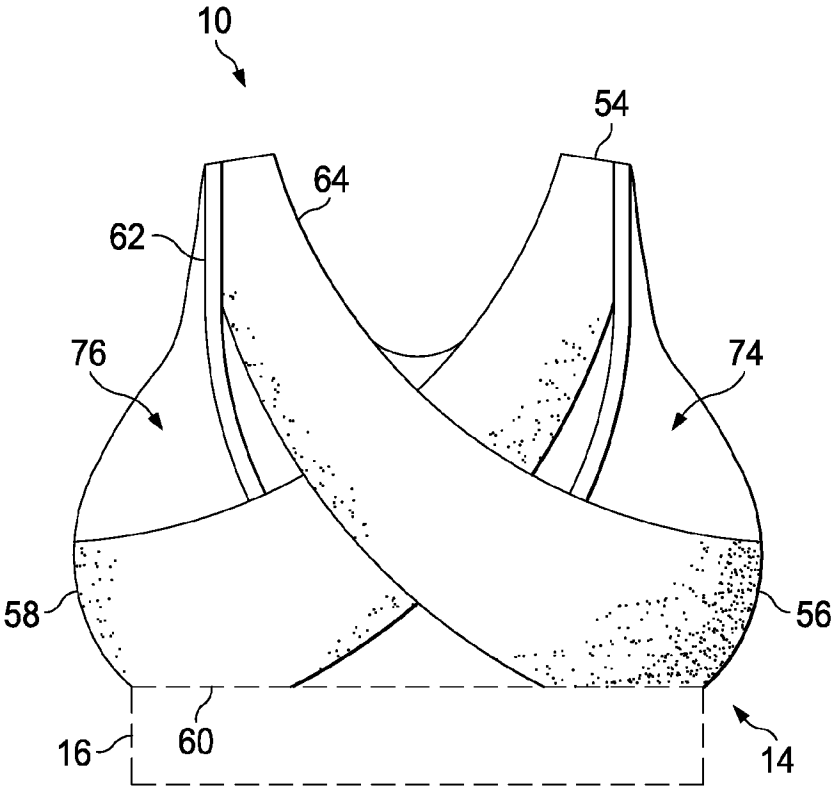
FIG. 4 depicts a rear view of a support garment according to an embodiment where the band is shown in dashed lines.

In various embodiments, the first pair of straps 62 may be indirectly or directly coupled to cups 34, the back panel 14, or to the band 16. For example, in FIG. 2, the first pair of straps 62 are indirectly coupled to the back panel 14 via lashing rings, such as b-rings 68. In another embodiment, in FIG. 3, the first pair of straps 62 are directly coupled to the bottom of the support garment 10 (e.g., at the band 16). In various embodiments, the second pair of straps 64 may be indirectly or directly coupled to the outer layer 20, the back panel 14, or the band 16. In FIG. 3, the second pair of straps 64 are coupled to the back panel 14. As shown in FIG. 4, in an example, the second pair of straps 64 crisscross each other and are coupled to or integral with the back panel 14.

The size of the first and second pair of straps 62, 64 may vary. For example, the first pair of straps 62 may have a width in a range of 0.1 inch to 3 inches. The second pair of straps 64 may have a width in a range of, for example, 0.1 inches to 6 inches. For example, the width can be 0.5 inch, 1 inch, 2 inches, etc. Additionally, the thickness and size of the material of the first and second pair of straps 62, 64 may vary. In an embodiment, the first pair of straps 62 may have a greater thickness than the second pair of straps 64. In an embodiment, the second pair of straps 64 may have a greater width than the first pair of straps 62.

The material of the shoulder straps may vary. Materials for the shoulder straps may be stretchable, elastic, and/or breathable and can be in various forms such as a mesh or a knitted fabric. Suitable materials for the shoulder straps include, without limitation, elastic, an elastic mix, polyester, a polyester mix, spandex, a spandex mix, a polyester-spandex mix, Lycra, a Lycra mix, a polyester-Lycra mix, nylon, a nylon mix, a spandex-nylon mix, a polyester-nylon mix, or a combination thereof. The material of the second pair of straps 64 may be the same as the material for the front panel 12 and back panel 14. The amount of elasticity of the material for the straps may vary. Additionally, the shoulder straps may be composed of multiple types of fabric. The texture or finish of the material may vary. For example, the material may be flat and soft to the touch or may be textured, such as being "bumpy" with small ridges. In embodiments where the straps include a fastener (e.g., slider 66 or D-ring 68), the fasteners may be made of, without limitation, a metal or a polymer, such as a plastic or silicone, or a combination thereof. In an embodiment, the fastener may be textured (e.g., ridged) or coated with a material to increase friction to create a "locking" effect and better maintain that position during motion.

Referring again to FIGS. 1-2, the support garment 10 has a body 70 that defines a neck opening 72, a first arm opening 74, a second arm opening 76, and the torso opening 22. The body 70 of the support garment 10 can be defined at least by the front panel 12, back panel 14, band 16, and any shoulder straps. The shape of the front of the neck opening 72 may vary and may be, for example, a scoop-neck, square, sweetheart, semi-sweetheart, V-neck, U-neck, halter, or jewel shape. In an embodiment, the torso opening 22 is continuous (i.e., there is no closure feature that would allow a wearer to "open" or "close" the body 70 of the support garment 10).

Figure 5B:
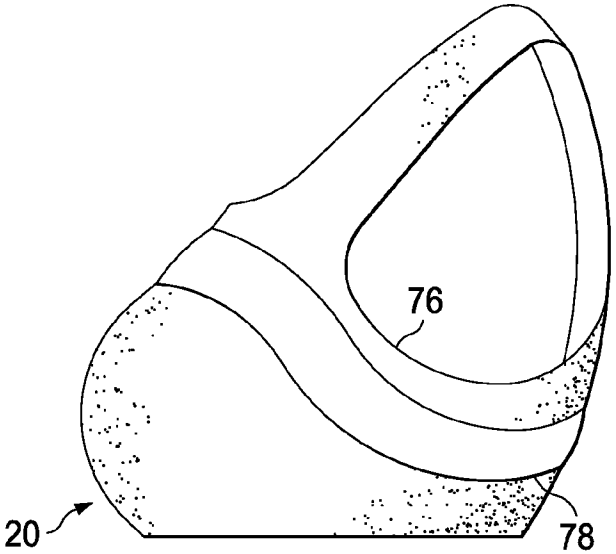
FIG. 5B depicts a partial side view of the outer layer of FIG. 5A.
Figure 5A:
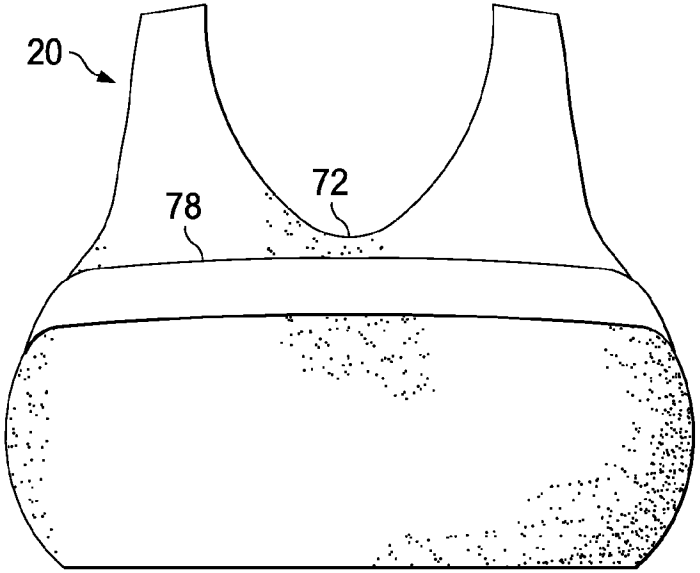
FIG. 5A depicts a front view of an outer layer of a support garment according to an embodiment.

The neck opening 72 will cover the majority or all of the user's breast tissue. The neck opening 72 may be positioned somewhere between 1 to 8 inches below the user's neck. The support garment 10 may be configured to reduce the breasts' upward range of motion. By resisting the breasts upward motion (e.g., the top of a bounce), the support garment 10 can lead to a reduction in momentum of the breasts during physical activity. In an embodiment, the material at the neck opening 72 may provide additional compression compared to the rest of the outer layer. For example, as shown in FIGS. 5A and 5B, a band 78 extends across the top of the bust line. The band 78 may be made of thicker or less-elastic fabric than the other portions of the outer layer 20. The band 78 may be integral with the outer layer 20 or may be an extra layer of fabric positioned on the outer layer 20. The band 78 may extend across just the outer layer 20, across the outer layer 20 under the arms and to the back panel 14, or around the entire support garment 10. The band 78 may form, in various embodiments, part of the neck opening 72 and/or part of the first and second arm openings 74, 76. In another embodiment, the band 78 is spaced apart from the neck opening 72 and the first and second arm openings 74, 76. The band 78 may or may not be visible from the outside of the support garment 10. In some embodiments, the outer layer 20 may be contoured using fabrics of different elasticity to create a downward force on the breasts during a bounce. For example, the top portion of the outer layer 20 may be made of a different fabric than the bottom portion to provide resistance to the upward movement. In another example, the outer layer 20 may have a sweetheart or other contoured shape.

In various embodiments, the support garment 10 can be configured to actively separate the breasts in addition to the separation created by the inner layer 18. In other words, the support garment 10 can be configured to create active separation by applying lateral tension across the breasts (i.e., away from the midline towards the sides of the user). To illustrate, when a user is in a plank or pushup position, the breasts of the user gravitate towards the lowest possible point on the body which means they move towards the middle, and with large breasts, the tissue meets and forms a "uniboob." In various embodiments, the lateral tension created by the support garment 10 counteracts this natural effect of gravity on the breasts that would cause them to move towards each other. The lateral tension can be generated in multiple ways as described below.

In various embodiments, tension bands may be coupled to the cups providing lateral tension. Referring to FIGS. 7A-8B, tension bands 80 may be coupled at a first end 82 to the cups 34 and extend around the sides of the user towards the back. The second end 84 of the tension bands 80 (i.e., the end opposite that coupled to the inner layer 18) may be coupled to a portion of the support garment 10, such as the back panel 14, the band 16, or the belt 26. In an embodiment, the tension band 80 may be coupled to the seam 86 between the back panel 14 and the band 16. In an embodiment, the tension bands 80 may be coupled to the belt 26 so that, when the belt 26 is tightened, the tension bands 80 are also tightened. The tension bands 80 may extend around the back of the support garment 10 and be attached at the back or to the opposite side. In an embodiment, the ends of the tension bands 80 may be looped through a lashing ring, such as an O-ring, on the side or back of the support garment 10 and change direction to extend towards the front of the support garment 10 (similar to the configuration involving the ends of the inner layer shown in FIG. 14) where it can be coupled to the respective tension band 80 or another portion of the support garment 10. The connection of the tension bands 80 may be fixed or may be adjustable (i.e., to adjust the lateral tension applied) using, for example, a slider, a buckle, a hook-and-eye closure, hook-and-loop closure (e.g., VELCRO), or a combination thereof. The tension bands 80 may be made of a material that pulls each edge 40, 42 of the inner layer 18 outward. Suitable materials for the tension bands 80 include, without limitation, elastic, an elastic mix, polyester, a polyester mix, spandex, a spandex mix, a polyester-spandex mix, LYCRA, a LYCRA mix, a polyester-LYCRA mix, nylon, a nylon mix, a spandex-nylon mix, a polyester-nylon mix, or a combination thereof.

Figure 7A:
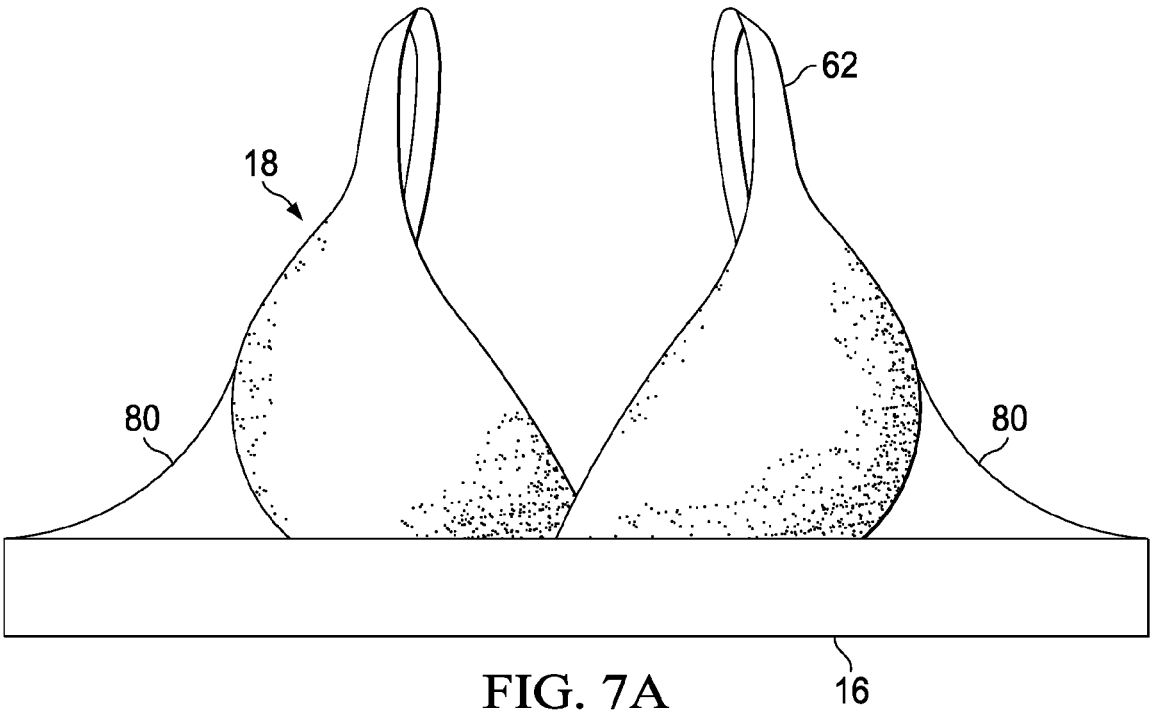
FIG. 7A depicts a front view of an inner layer and band of a support garment according to an embodiment with the outer layer removed.
Figure 7B:
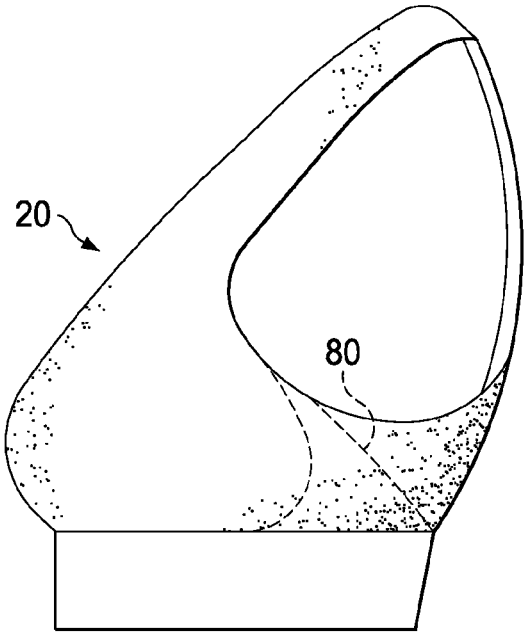
FIG. 7B depicts a partial side view of the support garment of FIG. 7A.
Figure 8A:
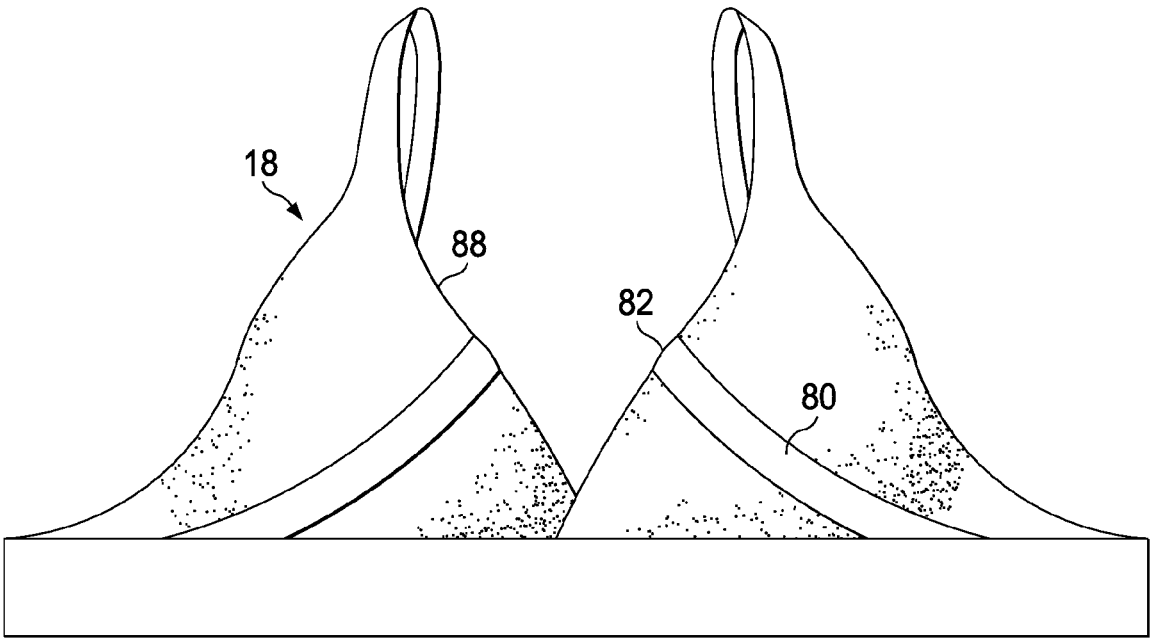
FIG. 8A depicts a front view of an inner layer and band of a support garment according to an embodiment with the outer layer removed.
Figure 8B:
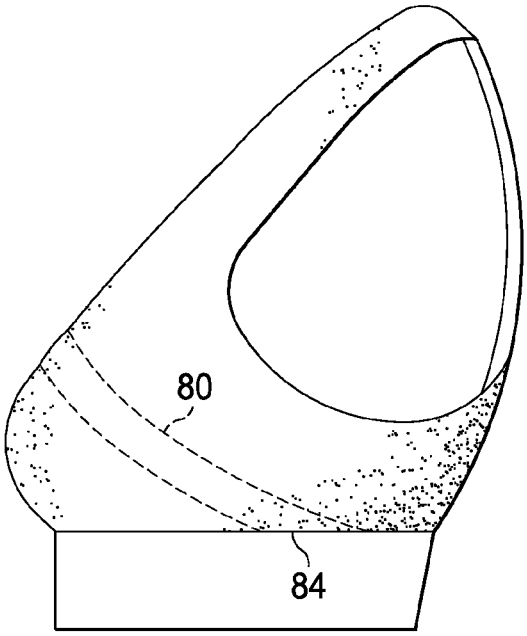
FIG. 8B depicts a partial side view of the support garment of FIG. 8A.

The area of the inner layer 18 coupled to the tension bands 80 may vary. As shown in FIGS. 7A and 7B, in an embodiment, one of the tension bands 80 may be coupled to the first side edge 40 of the inner layer 18, and the other of the tension bands may be coupled to the second side edge 42 of the inner layer 18. The tension bands may extend from the side edges 40, 42 around the sides of the user. In an embodiment, the tension bands 80 may be in the form of a triangular panel that extends between the edge of the cup 34 and the band 16. With reference to FIGS. 8A and 8B, in an embodiment, the first ends 82 of the tension bands 80 may be coupled to the inner edges 88 of the cups 34. The tension bands 80 may then extend across the width of the cups 34 towards the back panel 14 or the band 16. In an embodiment, the second ends 84 of the tension bands 80 may be coupled to the belt 26, and tightening the belt 26 may cause the tension bands 80 to apply a greater lateral tension to the breast tissue.

It should be recognized that lateral tension can be created with different seams, fabrics, or contouring of the cups 34 and inner layer 18. For example, the breast tissue could sit in the cups 34 in a way that separates the breasts from each other and holds them in that position. The support garment 10 can also apply lateral tension across the entirety of the cups 34 or a portion of the cups 34. The cups 34 can be connected into the outer layer 20 and/or the back layer 14 under the armpit or anywhere from the start of the cup 34 (in between the breasts of the user) to the back layer 14 of support garment 10.

In use, a wearer will pull on a support garment according to an embodiment, such as support garment 10, over their head. Once the support garment 10 is positioned such that each breast is supported by and encapsulated in the inner layer 18, the support garment is secured to the wearer. In an embodiment, the tension of the band 16 may be adjusted to sit snugly on the user's rib cage. For example, the belt 26 may be tightened. In an embodiment where the tension bands 80 are adjustable, the user may adjust the tightness of the tension bands 80. The support garment 10 both separates and compresses the wearer's breasts to reduce inertia and related pain during physical activity.

Figure 9:
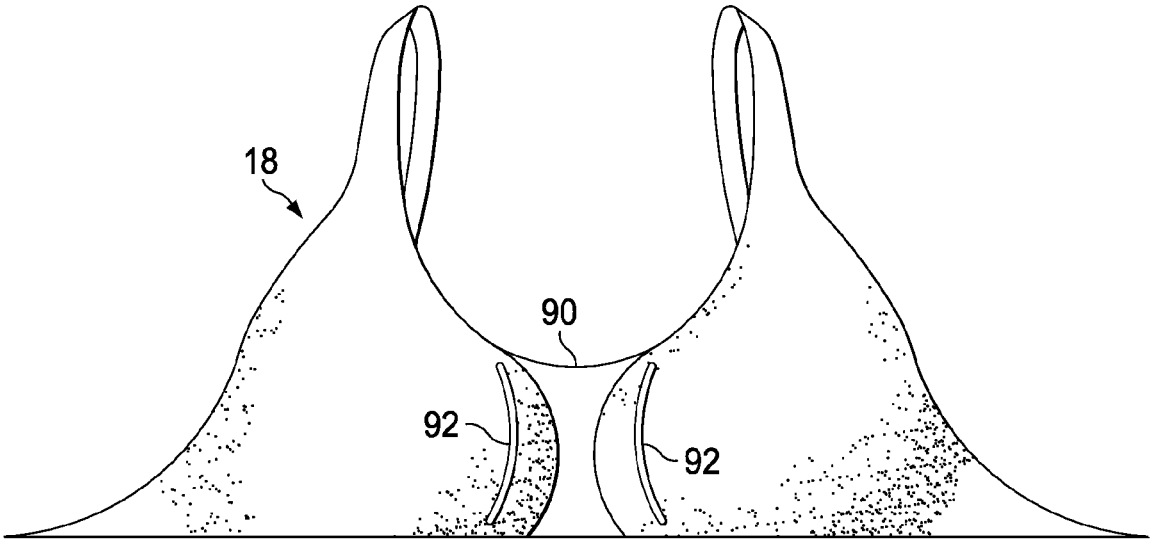
FIG. 9 depicts a schematic view of an inner layer of a support garment according to an embodiment including physical separation features.
Figure 10:
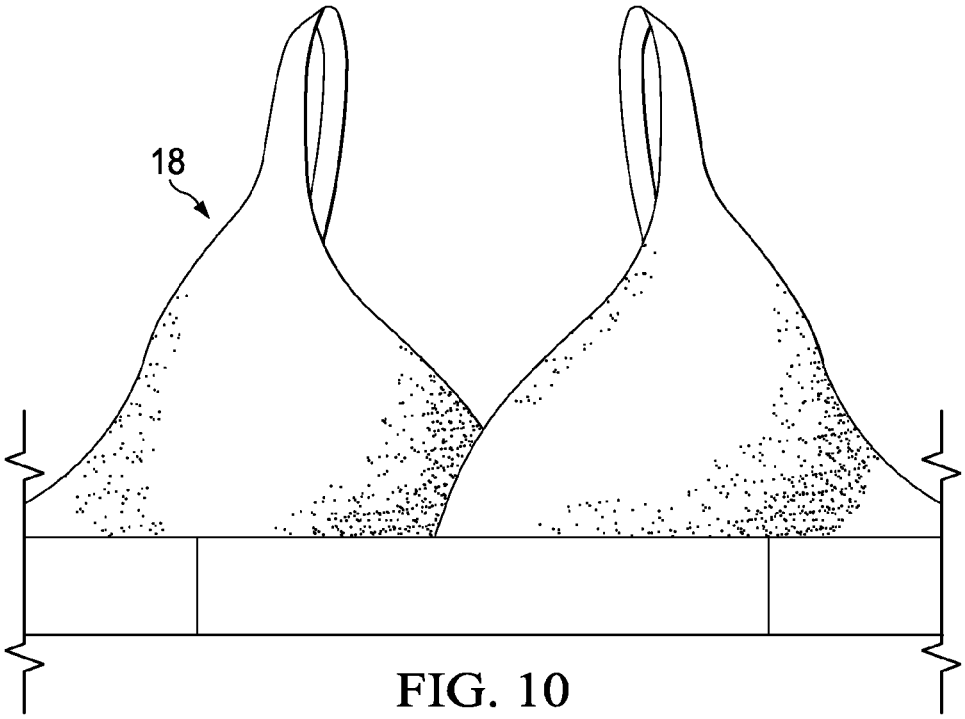
FIG. 10 depicts a front view of an inner layer of a support garment according to an embodiment.

In some embodiments, the support garment 10 may include a physical separation feature that prevents the breasts from moving towards each other. For example, the inner layer 18 may include a barrier 90 that maintains separation of the breasts. As shown in FIG. 9, in an embodiment, the barrier 90 may be, for example, a wedge that extends from the inner layer 18 towards the sternum of the wearer (i.e., away from the outer layer 20) between the breasts. The barrier 90 may be made of, for example, foam.

In some embodiments, the barrier 90 may be covered in fabric. In an embodiment, the barrier 90 is also used in the inner layer 18. In various embodiments, the support garment 10 may include an inner wire 92. For example, as shown in FIG. 9, the inner layer 18 may include a curved inner wire 92 that extends downward around the side of the breast. In an embodiment, the inner wire may also curve around the bottom of the breast towards the side of the wearer. In some embodiments, the inner wire may be formed from metal, silicone, foam, or fabric. These physical separation features may be used separately, may be combined in an embodiment, and may be used in combination with the tension bands 80.

Figure 12:
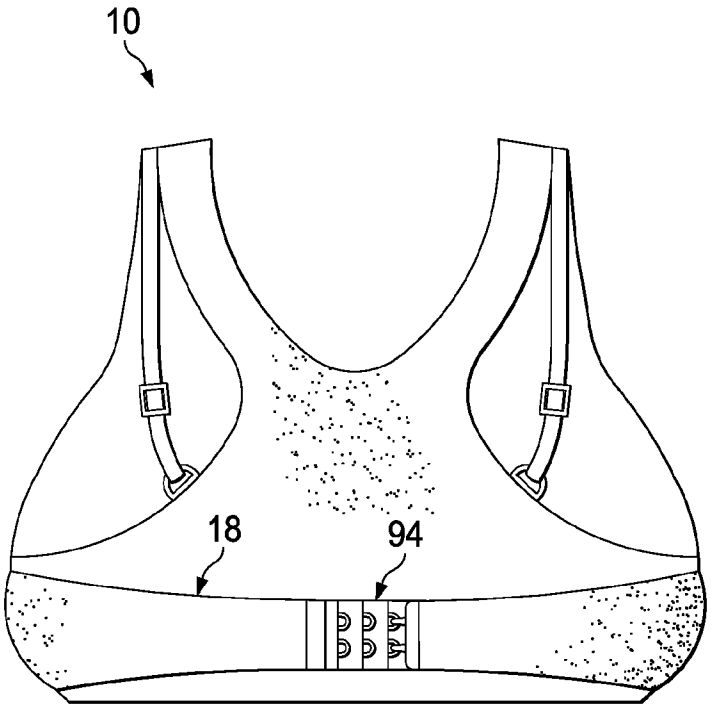
FIG. 12 depicts a rear view of a layer of a support garment according to an embodiment.
Figure 11:
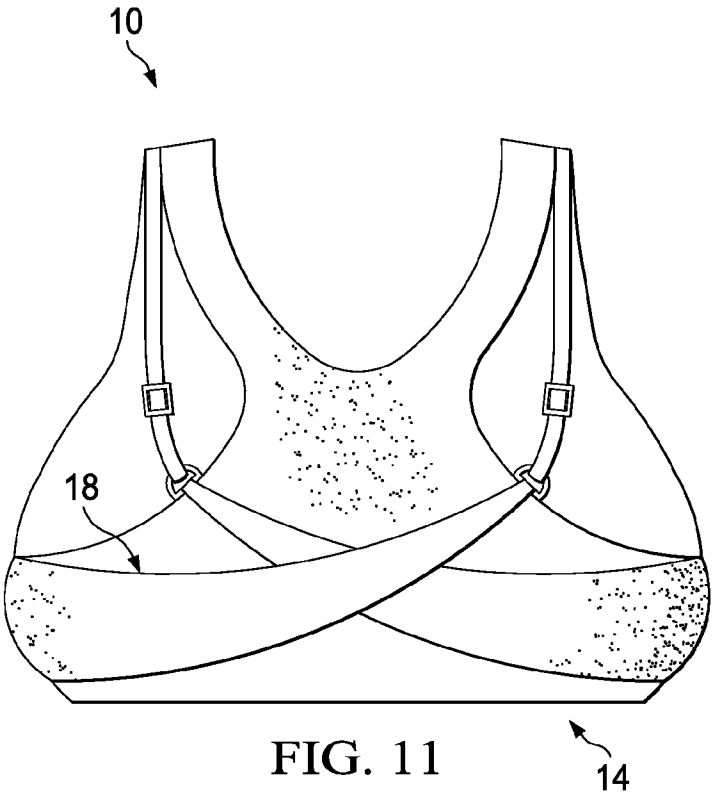
FIG. 11 depicts a rear view of a layer of a support garment according to an embodiment.
Figure 14:
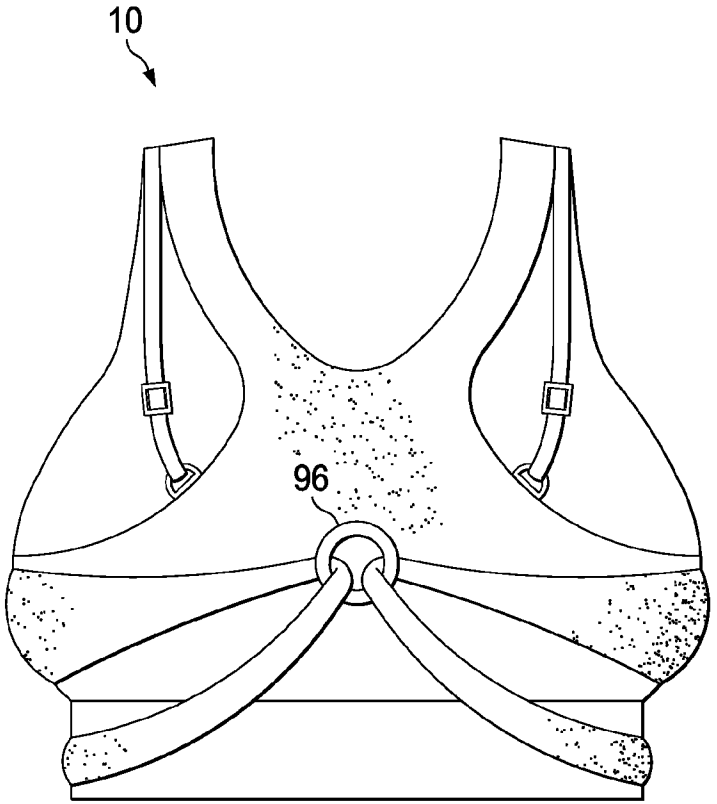
FIG. 14 depicts a rear view of a layer of a support garment according to an embodiment.
Figure 13:
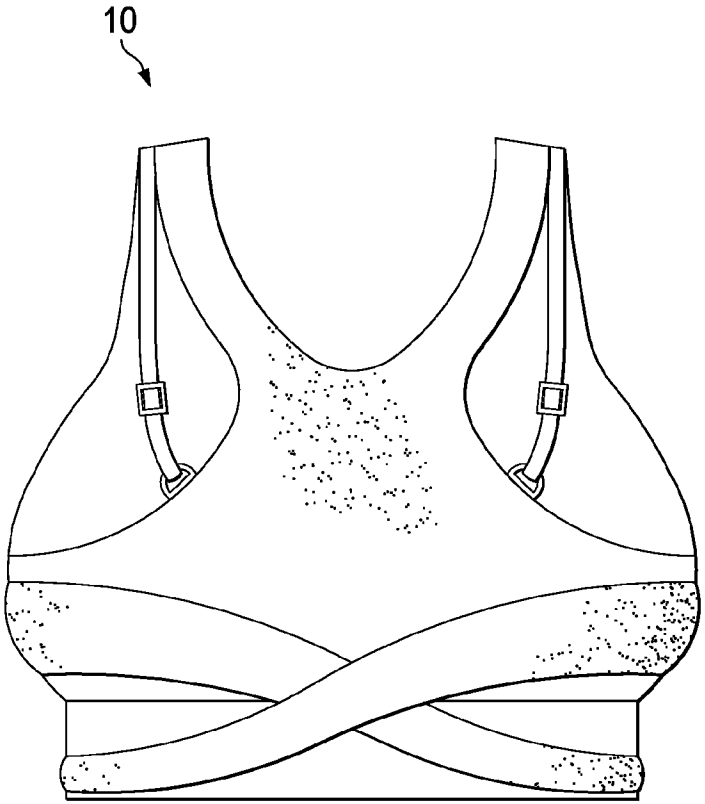
FIG. 13 depicts a rear view of a layer of a support garment according to an embodiment.

With reference to FIGS. 10-14, in some embodiments, the inner layer 18 of the front panel 14 may extend around the back of the support garment 10. The ends of the inner layer 18 may act as the tension bands to create lateral tension on the breasts. As shown in FIG. 11, in an embodiment, the ends of the inner layer 18 may extend around the back and be coupled to the back panel 14 where the opposite shoulder strap is coupled. As shown in FIG. 12, in an embodiment, the ends of the inner layer 18 may be coupled to each other, for example, using a hook-and-eye fastener 94. In an embodiment, as shown in FIG. 13, the ends of the inner layer 18 may crisscross at the back of the support garment 10 and be coupled at the sides or front. As shown in FIG. 14, in an embodiment, the ends of the inner layer 18 may be looped through a lashing ring, such as an O-ring 96, and then extend towards the sides or front of the user. In some embodiments, the ends of the inner layer 18 (or the tension bands 80) may be configured to act as the belt 26 and be adjusted to secure the band 16 to the rib cage of the wearer. While FIGS. 13 and 14 show the ends of the inner layer positioned over the back panel 14, the disclosure is not so limited. In some embodiments, the ends of the inner layer 18 may positioned under the back panel 14. For example, the crisscrossed ends as shown in FIG. 13 may not be visible from the back of the support garment 10. In another example, the crisscrossed portion may be visible at the back but the ends may extend into a channel (e.g., similar to channel 30) on the band 16. In other embodiments, tension bands 80 may be in the configuration shown in FIGS. 11-14.

In some embodiments, the support garment 10 includes support bands. The support bands may act as the tension bands and the belt 26. The support bands promote separation of the breasts and bear the weight of the breasts, rather than allowing the weight to pull down on the shoulders and neck. In various embodiments, the support bands wrap from the front panel 12, around the back of the wearer, and are coupled together below the breasts of the wearer. The support bands may be coupled to the body 70 of the support garment 10 in a variety of locations. For example, the support bands may be coupled to the front panel 12. In some embodiments, the support bands are coupled to the inner layer 18 (e.g., to the surface of the inner layer 18 that faces the outer layer 20). In an embodiment, each of the support bands are coupled to one of the first and second side of the inner layer 18 (e.g., one coupled somewhere between the center of the inner layer 18 and first side edge 40 and the other coupled somewhere between the center and the second side edge 42). The support bands may be coupled to a portion of the inner layer 18 below the cups 34. In an embodiment, each of the support bands are coupled to one of the first and second side edges 40, 42 of the inner layer 18 (e.g., along a seam on the side of the support garment 10). In another embodiment, each of the support bands are coupled to the seam. The support bands may extend from the inner layer 18 to the exterior side of the back panel 14 through an opening between the inner layer 18 and the outer layer 20.

As described above, the support bands are fastened together at the front or sides of the support garment 10 below the breasts. For example, the support bands may be fastened at the center of the front of the support garment 10 via a fastener. Examples of a suitable fastener include, without limitation, a buckle, hook and loop (e.g., VELCRO), a butterfly clip, hook and eye, a button, a snap, a magnet, or a combination thereof. The length of each of the support bands may be adjustable. The fastener may be configured to allow a user to adjust the length of each support band 16, or there may be separate adjustment features. When the support bands are tightened, the breasts are further separated by the inner layer 18 of the front panel 12. For example, tightening the support bands causes the left and right sides of the inner layer 18 to move or stretch towards the sides of the body (i.e., in a direction away from the center of the chest). Advantageously, while the support garment 10 to have no closure features on the front or back panels 12, 14 (i.e., the support garment 10 can be pulled on over the head), such a configuration allows for the initial fit of the support garment 10 on a wearer to be tightened. Because the fastener is positioned at the front or sides of the support garment 10, it is easier for the wearer to adjust the fit compared to adjustable back closures.

In an embodiment, the support bands may be visible at the back of the support garment 10. In various embodiments, the support bands may not be visible from the back of the support garment 10. For example, the bottom portion of the back panel 14 may have a channel between layers of fabric through which the support bands extend. In an embodiment, the channel may extend from the back panel 14 to the front panel 12 such that only a portion of the support bands near the fastener is visible from the outside of the support garment. In various embodiments, a portion of the support bands may be visible at the front of the support garment 10. The wearer is able to access the fastener to adjust the support bands.

As described above, the support bands loop from the front of the support garment, across the back, and are fastened below the breasts. In various embodiments, a support band 16 extends from each side of the front panel 12, around the back panel 14, and around a portion of the front panel 12. In an embodiment, the support bands may crisscross over the back panel 14. In such a configuration, the support bands may be angled relative to one another (i.e., not parallel when extended from the support garment 10). In another embodiment, one of the support bands may include an opening through which the other of the support bands may extend. In such a configuration, the support bands may rest on top of one another.

In use, a wearer will pull on a support garment according to an embodiment, such as support garment 10, over their head. Once the support garment 10 is positioned such that each breast is supported by and encapsulated in the inner layer 18, the support garment is secured to the wearer. In an embodiment, the support bands may be fastened, but loosened, while the user pulled on the support garment 10. Otherwise, the user may loop the support bands around the back and fasten them in the front via the fastener. The support bands may be pulled from the sides of the support garment 10 around the back. The support bands will circle around the back and towards the front and can be fastened together. After the support garment 18 has been secured and the support bands have been fastened together, the user may adjust the tightness of the support bands. The support garment 10 both separates and compresses the wearer's breasts to reduce inertia and related pain during physical activity.

As described, breast movement during physical activity occurs in the X, Y, and Z planes (side to side, up and down, in and out). The support garments described herein reduce movement and inertia of the breasts, in ways particularly advantageous for users with large breasts, during physical activity. Side to side movement of the breasts can be reduced with the encapsulation, separation, and compression of the breasts. Up and down movement can be constrained with tension from the straps, resistance from the band 16, and compression from the neck opening and optional band. In and out movement can be reduced at least from the compression from the outer layer, tension applied by the straps, and lateral tension. The distance, and thus the inertia, is reduced via the redistribution of the breast tissue and the compression. The support garments described herein provide improved comfort during physical activity.

In various embodiments disclosed herein, a single component can be replaced by multiple components and multiple components can be replaced by a single component to perform a given function or functions. Except where such substitution would not be operative, such substitution is within the intended scope of the embodiments.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

What is claimed is:

1. A support garment comprising:
- a front side and a back side;
- a front panel, the front panel comprising:
  - an inner layer, the inner layer comprising a first cup, a second cup, and a first pair of straps; and
  - an outer layer, the outer layer comprising a second pair of straps, wherein the outer layer is configured to provide compression when worn;
- a back panel, wherein the first pair of straps and the second pair of straps each extend between the front panel and the back panel;
- a band defining a torso opening, the band extending below the front panel and the back panel; and
- a first tension band and a second tension band, wherein the first tension band and the second tension band crisscross at the back side to apply lateral tension to the first cup and the second cup.

2. The support garment of claim 1, further comprising:
- the first tension band having a first end and a second end, the first end of the first tension band being coupled to the first cup; and
- the second tension band having a first end and a second end, the first end of the second tension band being coupled to the second cup.

3. The support garment of claim 2, wherein the second end of the first tension band and the second end of the second tension band are coupled to the back panel, the band, or a combination thereof.

4. The support garment of claim 2, wherein the first end of the first tension band is coupled to an inner edge of the first cup, and the second end of the second tension band is coupled to an inner edge of the second cup.

5. The support garment of claim 2, wherein the first end of the first tension band is coupled to the first cup at a first side of the inner layer, and the second end of the second tension band is coupled to the second cup at the second side of the inner layer.

6. The support garment of claim 1, further comprising a lashing ring positioned adjacent the back panel, wherein the first tension band extends from the first cup through the lashing ring and towards the first cup, and the second tension band extends from the second cup through the lashing ring and towards the second cup.

7. The support garment of claim 1, wherein at least one of the first tension band and the second tension band are adjustable.

8. The support garment of claim 1, wherein the band further comprises an adjustable belt.

9. The support garment of claim 8, wherein the adjustable belt comprises a slider, lashing ring, a buckle, a hook-and-eye closure, a hook-and-loop closure, a zipper, or a combination thereof.

10. The support garment of claim 8, wherein the band defines a channel, and the adjustable belt extends through the channel.

11. The support garment of claim 8, wherein the band comprises belt loops, and the adjustable belt extends through the belt loops.

12. The support garment of claim 2, wherein the band further comprises an adjustable belt, and wherein the second end of the first tension band and the second end of the second tension band are coupled to the back panel, the band, the adjustable belt, or a combination thereof.

13. The support garment of claim 1, wherein a bottom of the first cup and a bottom of the second cup overlap.

14. The support garment of claim 1, wherein each strap of the first pair of straps is coupled to one or both of the front panel and the back panel using a lashing ring.

15. The support garment of claim 14, wherein the lashing ring is a D-ring, an O-ring, or a rectangular ring.

16. The support garment of claim 1, wherein the second pair of straps and the back panel form a racerback shape.

17. The support garment of claim 1, further comprising an upper band extending over a top of a bust line of a user, wherein the upper band is configured to reduce upward movement of breast tissue.

18. A support garment comprising:
- a front panel, the front panel comprising:
  - an inner layer, the inner layer comprising a first cup, a second cup, and a first pair of straps; and
  - an outer layer, the outer layer comprising a second pair of straps, wherein the outer layer is configured to provide compression when worn;
- a back panel, wherein the first pair of straps and the second pair of straps each extend between the front panel and the back panel; and
- a band defining a torso opening, the band extending below the front panel and the back panel, wherein the band comprises belt loops and an adjustable belt, wherein the adjustable belt extends through the belt loops;

wherein the support garment is configured to apply lateral tension to the first cup and the second cup.

19. The support garment of claim 18, further comprising:

a first tension band having a first end and a second end, the first end of the first tension band being coupled to the first cup; and a second tension band having a first end and a second end, the first end of the second tension band being coupled to the second cup, wherein the first tension band and the second tension band are respectively configured to apply lateral tension to the first cup and the second cup.

20. A support garment comprising:

a front panel, the front panel comprising:

an inner layer, the inner layer comprising a first cup, a second cup, and a first pair of straps, wherein a bottom of the first cup and a bottom of the second cup overlap; and an outer layer, the outer layer comprising a second pair of straps, wherein the outer layer is configured to provide compression when worn;

a back panel, wherein the first pair of straps and the second pair of straps each extend between the front panel and the back panel; and a band defining a torso opening, the band extending below the front panel and the back panel;

wherein the support garment is configured to apply lateral tension to the first cup and the second cup.

* * * * *